US010272303B2

(12) United States Patent
Spain

(10) Patent No.: US 10,272,303 B2
(45) Date of Patent: Apr. 30, 2019

(54) METHOD FOR RECONDITIONING GOLF TEES

(71) Applicant: Kyle Spain, La Canada, CA (US)

(72) Inventor: Kyle Spain, La Canada, CA (US)

( * ) Notice: Subject to any disclaimer, the term of this patent is extended or adjusted under 35 U.S.C. 154(b) by 0 days.

(21) Appl. No.: 16/018,083

(22) Filed: Jun. 26, 2018

(65) Prior Publication Data

US 2018/0296892 A1 Oct. 18, 2018

Related U.S. Application Data

(63) Continuation of application No. 13/799,886, filed on Mar. 13, 2013.

(51) Int. Cl.
*A63B 57/00* (2015.01)

(52) U.S. Cl.
CPC ..... *A63B 57/0012* (2013.01); *A63B 2225/30* (2013.01)

(58) Field of Classification Search
CPC ..... A63B 2225/30; A63B 57/0012
See application file for complete search history.

(56) References Cited

U.S. PATENT DOCUMENTS 1,779,910 A * 10/1930 Kisson ..... B43K 23/10 15/105.53
3,911,577 A * 10/1975 Nickel ..... A63B 57/203 30/241
5,562,553 A * 10/1996 Digerness ..... A63B 57/207 473/408
D633,588 S * 3/2011 McCrimmon ..... D19/73
2003/0159951 A1* 8/2003 Chan ..... A45C 11/34 206/214

* cited by examiner

*Primary Examiner* — Kenneth E Peterson
*Assistant Examiner* — Liang Dong
(74) *Attorney, Agent, or Firm* — William S. Parks

(57) ABSTRACT

Various devices for reconditioning golf tees are disclosed herein.

2 Claims, 3 Drawing Sheets

METHOD FOR RECONDITIONING GOLF TEES

CROSS-REFERENCE TO CORRELATED APPLICATION

This application is a continuation of pending U.S. patent application Ser. No. 13/799,886, filed on Mar. 13, 2013, the entire disclosure thereof is herein incorporated by reference.

The present disclosure relates generally to devices for reconditioning golf tees.

A game of golf begins by hitting the first shot off a tee box, and continues that way on each subsequent hole that is played. On every tee box, each player has the option of using a golf tee that is placed in the ground to position the ball for optimum hitting proficiency. Almost all golfers use golf tees on every tee box. Optimally, when a golf ball resting on a tee is struck, only the golf ball is hit. However in reality, more often than not, both the golf ball and tee are hit, thereby breaking the tee. Broken tees typically are not reused because they cannot easily be inserted back in the ground. Being splintered, or otherwise damaged, these broken tees are unusable and discarded.

SUMMARY

Briefly and in general terms, various embodiments are directed towards devices for reconditioning golf tees. According to one embodiment, the device includes a body having a bore extending into the body. A portion of the bore is sized only to accommodate a golf tee. The bore also terminates at a blunt conical point. The device also includes an opening positioned along a portion of the blunt conical point. The device further includes a cutting member positioned over a portion of the opening and is coupled to an outer surface of the body. The cutting member is positioned such that it is offset from a centerline of the bore.

In another embodiment, the device includes an inner body having a bore in which a portion of the bore is only sized to accommodate an outer diameter of a golf tee. The bore terminates at a blunt conical point and has an opening positioned along a portion of the blunt conical point. The device also includes a blade coupled to an outer portion of the inner body. The blade is positioned along the blunt conical point, and the blade is offset from a centerline of the bore. The device further includes an outer housing having an elongated body The outer housing has a recess extending into the elongated body. The outer housing also includes an aperture that is located on the outer housing such that the aperture corresponds to the opening on the inner body. In this device, the inner body Is fitted into the outer housing and the blade is secured between the inner body and the outer housing.

The device is designed specifically to refurbish broken golf tees into reusable golf tees, replicating the function and shape as original, new golf tees. Furthermore, features of the disclosed embodiments will become apparent from the following detailed description, taken in conjunction with the accompanying drawings.

DETAILED DESCRIPTION

Devices for reconditioning golf tees are disclosed herein. The device transforms a broken tee into a working golf tee by trimming off as little of the remaining portion of the broken tee as possible while at the same time sculpting the end of the broken tee into a shape that replicates the design of the original golf tee. While the resulting tee is generally shorter than the original tee, the reconditioned tee retains as much of its original length as possible because the device minimizes the amount of material needed to be removed in order to recondition the tee. The device also shapes the terminal end of the tee (i.e., the portion that is inserted into the ground) so that the tee terminates at a dull point.

Since the reconditioned tee has a dull point, a player is more inclined to fix a broken tee. Otherwise, a golfer would be subject to injury every time they reach into their pockets. Since golf tees are commonly carried in the golfer's subject to injury every time they reach into their pocket to retrieve the tee. With a dull point at the end of the recycled golf tee there is no possibility of this potential injury.

The device allows a golfer to recondition and reuse a tee. This is environmentally friendly as fewer trees are needed to make golf tees. Additionally, the device spares golf courses with the need of cleaning up and removing broken tees that usually litter tee boxes as well as reducing potential damage to lawn care equipment.

Figure 1:
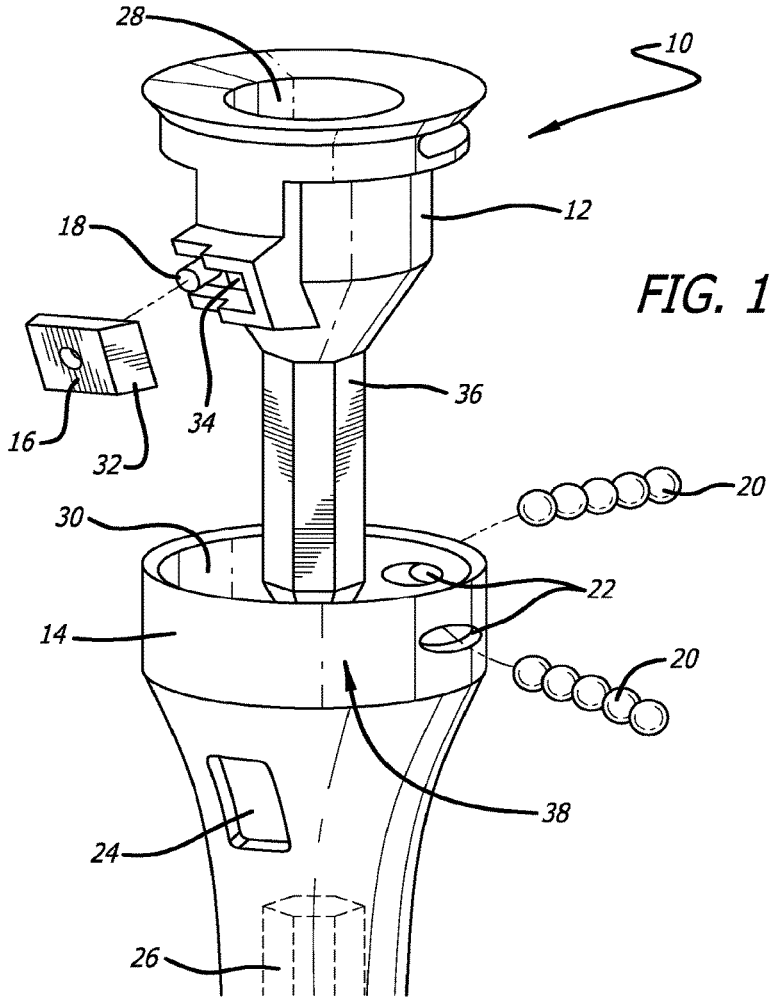
FIG. 1 is an exploded perspective view of one embodiment of a device for reconditioning golf tees.

FIG. 1 illustrates one embodiment of a device 10 for reconditioning golf tees. The device includes a body 12 that is generally elongated with a bore 28 extending substantially the length of the body. As shown in FIG. 1, the bore 28 has a large outer diameter at the opening at the top of the body 12 and tapers to a smaller diameter near the base of the body. At the smallest diameter of the bore 28, the bore is sized to accommodate a golf tee having a standard outer diameter. The bore 28 is sized so that a golf tee is fitted and able to rotate smoothly within the bore. In an alternate embodiment, the bore 28 has a uniform diameter that is sized to accommodate the outer diameter of a standard golf tee. In the various embodiments, the bore may have a length approximately ¼" to approximately ¾". As those skilled in the art will appreciate the bore may have any length to accommodate and sufficiently support the broken tee as it is reconditioned within the device.

Figure 2:
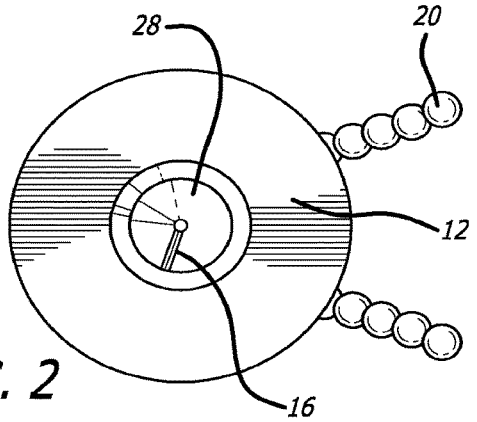
FIG. 2 is a top view of one embodiment of a device for reconditioning golf tees.

As shown in FIGS. 1-2, the device 10 includes a cutting member 16 such as, but not limited to, a blade, razor blade, or the like. The cutting member 16 is generally flat, thin, with at least one cutting edge 32. The cutting member also includes an opening 36 that is sized to engage a post 18 on the outer surface of the body 12. The cutting edge 32 of the cutting member 16 is positioned over an opening 34 provided on the body 12. The cutting member may be made form metal, ceramic, or any material known or developed in the art that can provide a sharp edge to trim and/or cut material away from a golf tee (typically made of wood and/or plastic).

In the embodiment shown in FIG. 1, the cutting member 16 is secured to the body 12 by friction fitting between the post 18 and the opening 36. Additionally, the blade is secured in position by being sandwiched between the body 12 and the outer housing 14. Alternatively, in another embodiment, the cutting member 15 is secured to the body 12 with one or more of the following: a screw, bolt, glue, and/or any other fastening means known or developed in the art.

As shown in FIG. 1, the bottom portion 36 of the body 12 has an outer diameter forming a generally hexagonal shape. As those skilled in the art will appreciate, the bottom portion of the body 12 any shape such as, but not limited to, a circle, a triangle, rectangle, square, or any other shape known or developed in the art. The bottom portion 36 of the body 12 and the opening 26 are joined together by an interference fit. In other embodiments, one or more fastening members or glue may be used to join the outer housing together with the body.

The device 10 also includes an opening 24 on the outer housing 14. The openings 34 on the body and the opening 24 on the outer housing are co-aligned. The openings are sized to allow the portions of the golf tee that are trimmed from the golf tee to be released from the bore 28.

The outer housing 14 also includes openings 22 that are sized to receive a chain or rope 20 to allow the device 10 to be attached to another object such as, but not limited to, a belt loop, belt, golf bag, golf bag strap, zipper opening, or the like. The outer housing 14 also includes one or more surfaces 38 in which text and/or the logo of a company, brand, or event title may be printed, etched, embossed, adhered, or otherwise applied to the device 12.

Figure 4:
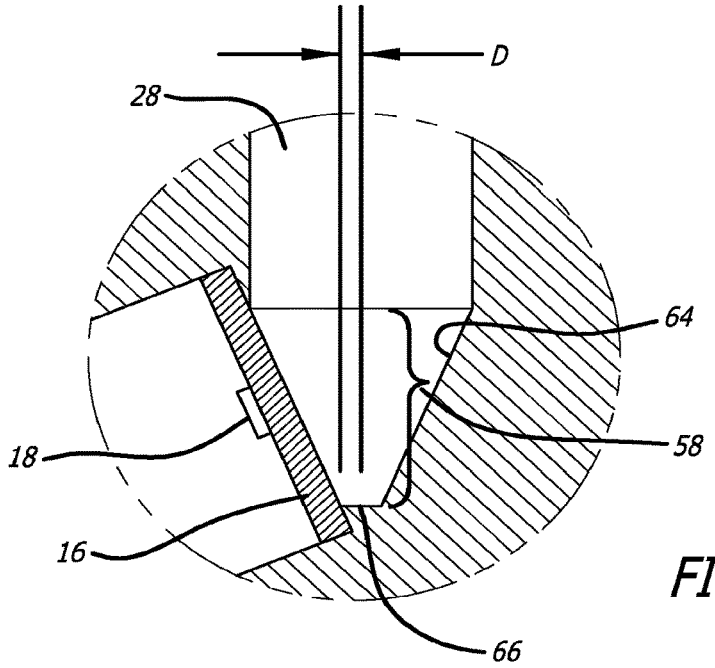
FIG. 4 is an enlarged section view of a portion of the device shown in FIGS. 1-2.

Turning now to FIG. 4, a cross-sectional view of the base of the body 12. As shown in FIG. 4 the base 12 terminates at a flat-bottomed, inverted cone 58. On a portion of the surface of the cone 58, the blade 16 is angled at an angle similar to the angle of the walls of the cone 58. The blade 16 is angled and positioned at the base of the body 12 in order to reduce the amount of material removed from the golf tee and maintain as much length of the tee as it is reconditioned. Additionally, the blade 16 is offset a distance D from the centerline of the bore 28. Accordingly, the blade 16 does not intersect the midline of the golf tee. Given the position and angle of the blade 16 at the base of the body 12, the reconditioned golf tee is formed with a generally blunt tip rather than a sharp tip, replicating a blunt tip of a new golf tee.

Figure 3A:
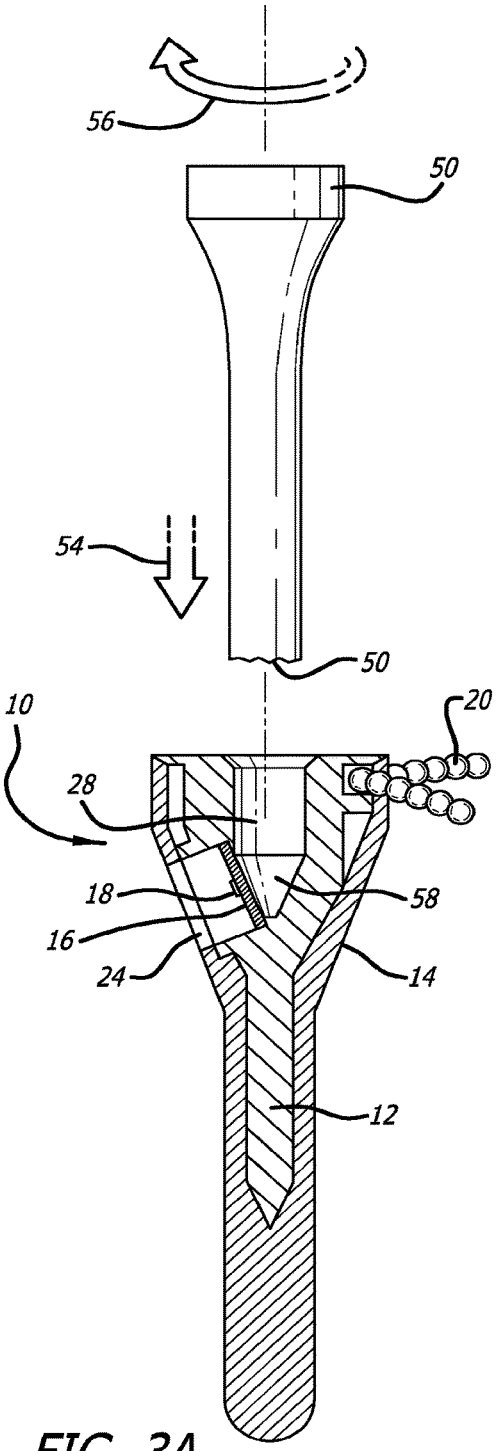
FIG. 3A is a side sectional view of a broken tee being inserted into one embodiment of the device shown in FIGS. 1-2.
Figure 3B:
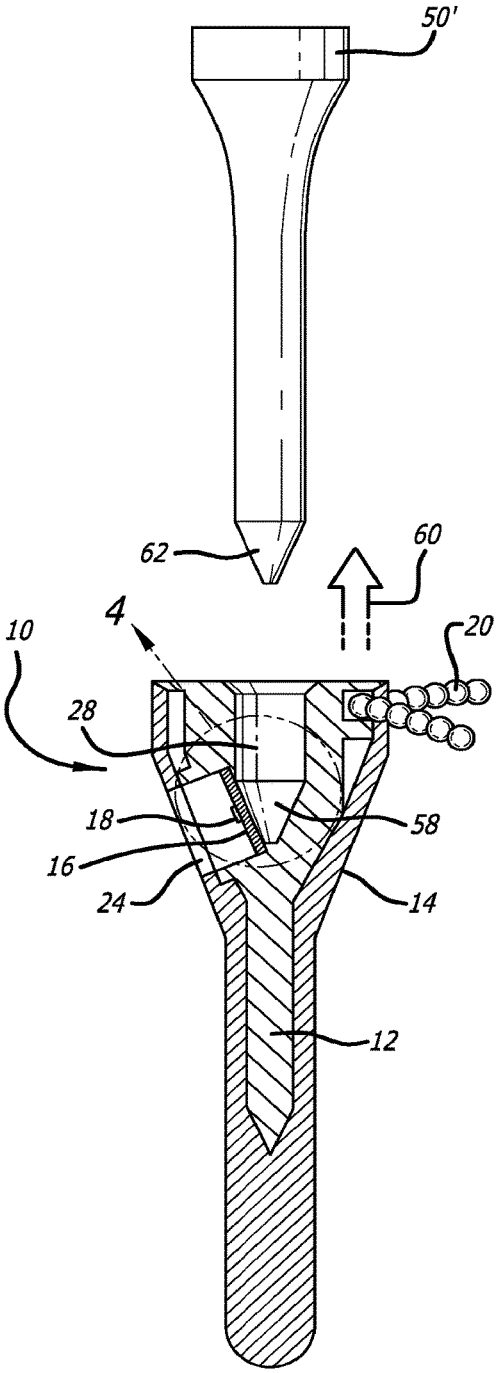
FIG. 3B is a side sectional view of a golf tee reconditioned and removed from one embodiment of the device shown in FIGS. 1-2.

FIGS. 3A-3B illustrates the recondition of a broken golf tee with one embodiment of a device 10. In FIG. 3A, the damaged end 52 of the golf tee 50 is inserted 54 in to the bore 28 of the device 10. The golf tee 50 is inserted into the device until the broken end of the device contacts the blade 16. Once the golf tee 50 is properly seated within the bore 28, the golf tee is rotated 56 about the longitudinal axis of the golf tee. As the broken tee is rotated, material trimmed from the broken tee 50 exits through the opening 24. FIG. 3B shows the reconditioned golf tee 50' being removed 60 from the device 10. As shown in FIG. 3B, the reconditioned golf tee 50 has a tapered end 62 and terminates at a dull point.

Figure 5:
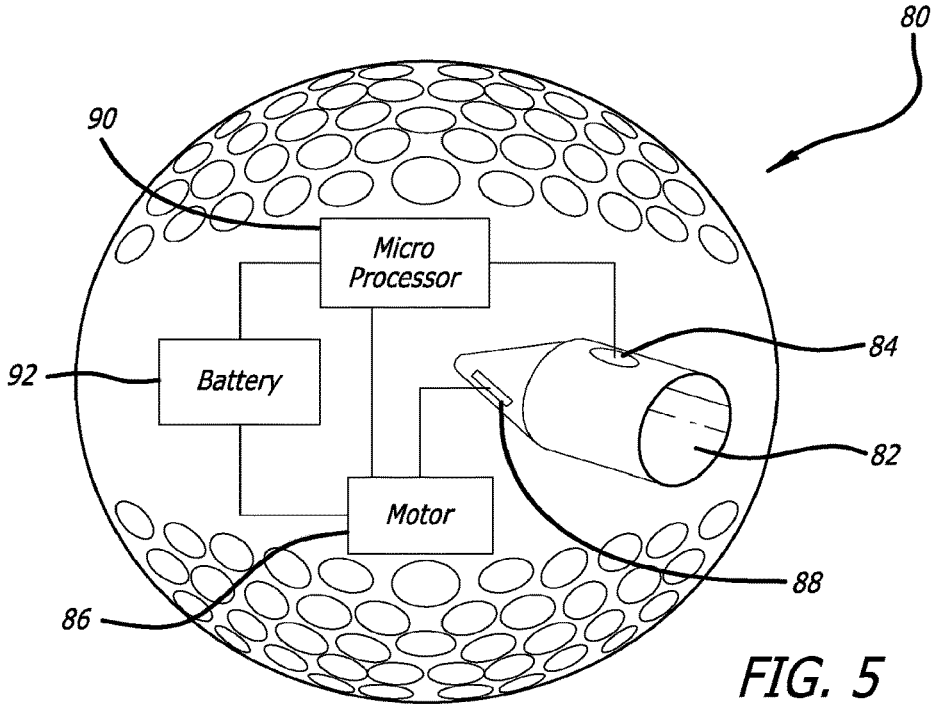
FIG. 5 is a perspective view of another embodiment of a device for reconditioning golf tees.

FIG. 5 illustrates another embodiment of a device 80 for reconditioning a golf tee. In this embodiment, the device 80 includes an electrical motor 86 housed within the device. The motor 86 drives the movement of a cutting member to refurbish the broken golf tee. As shown in FIG. 5, the motor is powered by a battery 92. The battery may be rechargeable or standard alkaline battery. In an alternate embodiment, the motor may be powered by AC current from a wall outlet or recharged with an AC/DC adapter.

In the embodiment of FIG. 5, the device 80 includes a microprocessor 90 that controls the operation of the motor 86. The microprocessor can turn the motor on and off, control torque of the motor, duration of operation, and the like. As shown in FIG. 5, the microprocessor 90 is connected to a sensor and/or an electromechanical switch 88. The sensor 88 detects the presence of a broken golf tee within the bore, and then the microprocessor controls the process in which the broken tee is refurbished. In another embodiment, the device is similar to the device shown in FIG. 5, except that the device does not include a microprocessor. In this embodiment, the electrical motor is operably coupled to a switch. The switch is located within the bore of the device and when triggered or actuated, the motor is turned on thereby causing the blade located within the bore to trim the broken tee.

The foregoing description, for purposes of explanation, uses specific nomenclature and formula to provide a thorough understanding of the disclosure. It should be apparent to those of skill in the art that the specific details are not required in order to practice the disclosure. The embodiments have been chosen and described to best explain the principles of the disclosure and its practical application, thereby enabling others of skill in the art to utilize the disclosure, and various embodiments with various modifications as are suited to the particular use contemplated. Thus, the foregoing disclosure is not intended to be exhaustive or to limit the disclosure to the precise forms disclosed, and those of skill in the art recognize that many modifications and variations are possible in view of the above teachings.

What is claimed is:

1. A method of reconditioning a golf tee having an initial sharpened end for insertion within the ground and wherein said golf tee exhibits a broken portion adjacent to said sharpened end after use, said method comprising the steps of:

a) providing a sharpening device having an inner body and an outer body;

i) wherein said inner body comprises:

an inner surface, an outer surface, a top portion, a bottom portion, and a middle portion;

wherein said inner body inner surface is defined by an inner body bore having a centerline and terminating at a blunt conical point;

wherein said inner body top portion has an opening leading from said outer surface to said inner surface defined as said inner body bore, said inner body bore further extending within said inner body middle portion and having a top portion and a bottom portion, wherein said inner body bore top portion begins at said opening of said inner body top portion and ends at the inner body bore bottom portion, wherein said inner body bore top portion exhibits a cylindrical shape at and below said opening and said inner body bore bottom portion exhibits a conical shape terminating at said blunt conical point, wherein said inner body inner surface exhibits a flat bottom with conical sides leading upward to said cylindrical shape wherein said cylindrical shape exhibits a diameter of a larger size than that of said flat bottom;

wherein said inner body bottom portion has a closed end and an extension having a preselected shape; and wherein said inner body middle portion has an angled opening therein leading from said bore to said inner body outer surface, wherein said opening includes an extension from said inner body outer surface for holding a cutting member disposed therein at the angle of said opening and defining an edge for said opening, offset from said bore centerline, and in contact with said inner body outer surface, and wherein said opening is positioned along a portion of said blunt conical point of said inner body bore bottom portion, wherein said cutting member is aligned with said conical structure of said inner body inner surface as a sharpening implement;

ii) wherein said outer body comprises:

an inner surface, an outer surface, a top portion, a bottom portion, and a middle portion;

wherein said outer body inner surface is defined by a recess;

wherein said outer body top portion has an opening leading to said recess extending within said middle and bottom portions;

wherein said outer body bottom portion has a closed end;

wherein said recess is of a shape similar to that of said inner body bottom portion extension;

wherein said outer body top portion includes at least two openings to receive a chain or rope;

and wherein said outer body middle portion has an opening co-aligned with said inner body middle portion opening at the outer body inner surface;

wherein said cutting member is secured between said inner body outer surface and said outer body inner surface through simultaneous contact with said extension from said inner body outer surface, wherein said inner body middle portion opening edge is also in contact with the outer body inner surface; wherein said inner body top portion opening and said inner body bore are of a diameter to accommodate a golf tee; wherein said inner body is interference fit within said outer body such that a golf tee inserted within said inner body bore may be freely rotated therein for reconditioning upon repeated contact with said cutting member; and wherein said inner body does not rotate as inserted and interference fit within said outer body;

b) inserting a damaged end of a golf tee within said inner body bore of said device;

c) rotating said golf tee within said bore until said golf tee contacts said blunt conical point; and d) removing said golf tee;

wherein said golf tee of step "d" exhibits a blunt point.

2. The method of claim 1 wherein said recess of said outer body and said extension of said inner body bottom portion are hexagonal in shape.

* * * * *